US011571829B1

(12) United States Patent
Simkovitz

(10) Patent No.: US 11,571,829 B1
(45) **Date of Patent: *Feb. 7, 2023**

(54) NAPE HAIR SHAVING DEVICE

(71) Applicant: Reid Simkovitz, Marlton, NJ (US)

(72) Inventor: Reid Simkovitz, Marlton, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/385,357

(22) Filed: Jul. 26, 2021

Related U.S. Application Data

(62) Division of application No. 16/208,746, filed on Dec. 4, 2018, now Pat. No. 11,104,021.

(51) Int. Cl.
*B26B 21/52* (2006.01)
*B26B 21/40* (2006.01)

(52) U.S. Cl.
CPC ..... *B26B 21/522* (2013.01); *B26B 21/4075* (2013.01)

(58) Field of Classification Search
CPC ... B26B 21/522; B26B 21/4075; B26B 21/52; B26B 21/152; B26B 21/10; B26B 21/523; B26B 19/042
See application file for complete search history.

(56) References Cited

U.S. PATENT DOCUMENTS 1,385,722 A * 7/1921 Sessoms ..... A45D 24/36 132/214
2,587,336 A * 2/1952 Larson ..... A01D 1/04 30/309
2,610,393 A * 9/1952 Hammond ..... B26B 21/00 30/41.5
2,991,553 A * 7/1961 Levine ..... B26B 21/00 30/356
5,426,853 A * 6/1995 McNinch ..... B26B 21/14 30/527
6,125,857 A * 10/2000 Silber ..... B26B 21/00 132/289
6,308,416 B1 * 10/2001 Bosy ..... B26B 21/522 30/527
6,434,828 B1 * 8/2002 Andrews ..... B26B 21/56 30/529
D621,544 S 8/2010 Bommarito
8,015,711 B2 * 9/2011 Psimadas ..... B26B 21/52 30/526
8,141,258 B1 * 3/2012 Frisch ..... B26B 21/527 30/526

(Continued)

*Primary Examiner* — Evan H MacFarlane
*Assistant Examiner* — Fernando A Ayala
(74) *Attorney, Agent, or Firm* — Goldstein Law Offices, P.C.

(57) ABSTRACT

A nape hair shaving device for allowing a user to shave hair on a nape located behind the user's neck, comprising an arcuate shaving bar and a plurality of razors projecting therefrom to form a curved shaving arc which conforms to the shape of the user's neck. The user employs the shaving device by grasping the shaving device via a pair of grips with the arcuate shaving bar horizontally positioned therebetween, positioning the shaving arc above the nape, and making a shaving motion by drawing the shaving arc downwardly over the nape to cut the hair growing thereon. The arcuate shaving device is further flexible and is adapted to be bent inwardly or outwardly to selectively vary the size of the shaving arc. The plurality of razors are selectively detachable, allowing dulled razors to be removed and replaced.

13 Claims, 5 Drawing Sheets

(56) References Cited

U.S. PATENT DOCUMENTS

| | | | | |
|---|---|---|---|---|
| 8,782,911 | B1 | 7/2014 | Greene | |
| 9,931,754 | B1 | 4/2018 | Schmidt | |
| 2003/0177648 | A1* | 9/2003 | Zeiter | B26B 21/523 30/526 |
| 2009/0025234 | A1* | 1/2009 | Carlucci | B26B 19/042 30/527 |
| 2011/0283540 | A1 | 11/2011 | Wetteroff | |
| 2013/0019484 | A1 | 1/2013 | Allen et al. | |
| 2017/0334080 | A1 | 11/2017 | Dryfhout | |
| 2020/0290226 | A1* | 9/2020 | Lucchese | B26B 21/522 |

* cited by examiner

NAPE HAIR SHAVING DEVICE

CROSS-REFERENCE TO RELATED APPLICATIONS

This application is a divisional of U.S. patent application Ser. No. 16/208,746, filed on Dec. 4, 2018, the contents of which are relied upon and incorporated herein by reference in their entirety.

TECHNICAL FIELD

The present disclosure relates generally to a hair cutting device. More particularly, the present disclosure relates to a nape hair shaving device which allows a user to efficiently shave the hair growing on the user's nape.

BACKGROUND

Short hairstyles generally involve cutting hair short at the back of the head to expose the nape of the neck. Furthermore, the hair on the nape of the neck is trimmed to create a neat hairline. In order to preserve the hairline at the nape and maintain a well-groomed appearance, a person with short hair will usually endeavor to shave or trim the hair growing from the nape of the user's neck. Shaving the hair from the nape is easily accomplished using a standard straight razor, safety razor, cartridge razor, or other conventional razor, with the help of another person, such as a barber. However, a person cannot perform this task unaided using a conventional razor without great difficulty and frustration.

Many devices exist in the prior art which are designed to allow a user to shave, cut, or trim hair located on the rear of the user's own body, including the neck or the back. However, many of these devices involve the use of large, curved blades which are potentially dangerous to use, cannot be replaced, and are difficult to sharpen. Other devices allow the user to safely maneuver a single safety razor or other cutting implement. However, such devices are limited by the small cutting surface of the single razor and do not allow the user to evenly and efficiently shave the hair from the user's nape, as repeated strokes using the single razor are slow and areas of hair may be easily missed and overlooked by the user.

A need therefore exists for a device which allows the hair on the user's nape to be removed evenly, efficiently, and safely, while also allowing any dulled cutting surfaces to be easily replaced.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a shaving device which allows a user to shave hair located on the nape of the user's neck without the assistance of another person. Accordingly, the present disclosure provides a nape hair shaving device having a curved arcuate shaving bar and a plurality of razors which project therefrom, forming a curved shaving arc which conforms to the user's nape, allowing the user to shave the hair from the user's nape by positioning the nape hair shaving device behind the neck above the nape, and shaving the hair from the nape using a downward shaving motion.

It is another aspect of an example embodiment in the present disclosure to provide a shaving device which allows the user to evenly shave the hair located on the user's nape. Accordingly, the present disclosure provides a nape hair shaving device, whereby the razors within the shaving arc are positioned adjacent to one another, and the shaving motion produces a plurality of adjacent shaved areas on the user's nape. Uncut hair between the shaved areas are cut by laterally adjusting the shaving device and repeating the shaving motion.

It is yet another aspect of an example embodiment in the present disclosure to provide a shaving device which is easy to maneuver by the user. Accordingly, the present disclosure provides a nape hair shaving device having a first grip and a second grip which are adapted to be grasped in the user's right and left hands with the arcuate shaving bar positioned horizontally therebetween, and the downward motion is achieved by drawing the shaving arc downward through a simultaneous downward motion by the user's right and left hands.

It is a further aspect of an example embodiment in the present disclosure to provide a shaving device which is flexible and capable of adapting to the shape and size of the user's neck. Accordingly, the present disclosure provides a nape hair shaving device having an arcuate shaving bar which is flexible and is adapted to be bent inwardly and outwardly to vary the shape of the shaving arc and selectively increase or decrease the distance between each razor within the shaving arc.

It is yet a further aspect of an example embodiment in the present disclosure to provide a shaving device which allows dulled razors to be replaced with new razors. Accordingly, the present disclosure provides a nape hair shaving device having selectively detachable razors.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
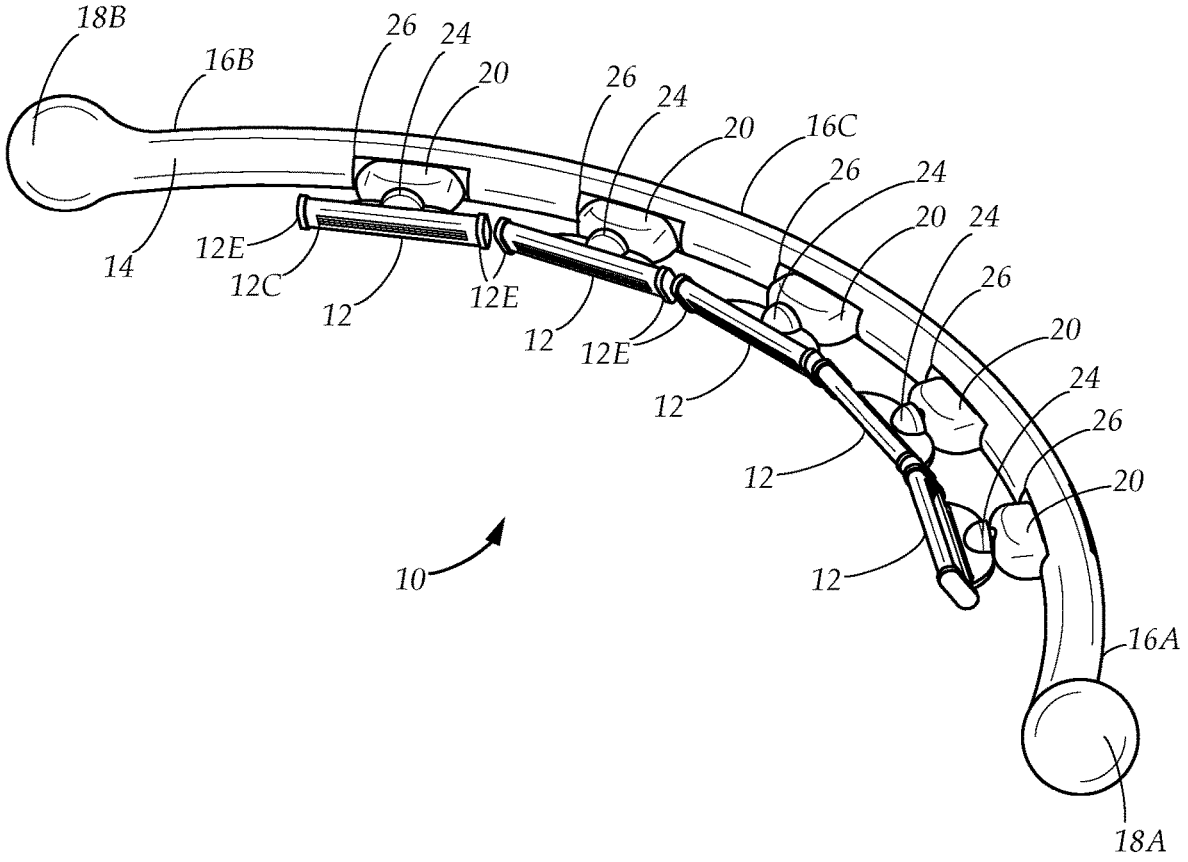
FIG. 1 is a diagrammatic perspective view depicting a nape hair shaving device having an arcuate shaving bar, a pair of grips, and a plurality of razors, in accordance with an embodiment of the present disclosure.
Figure 2:
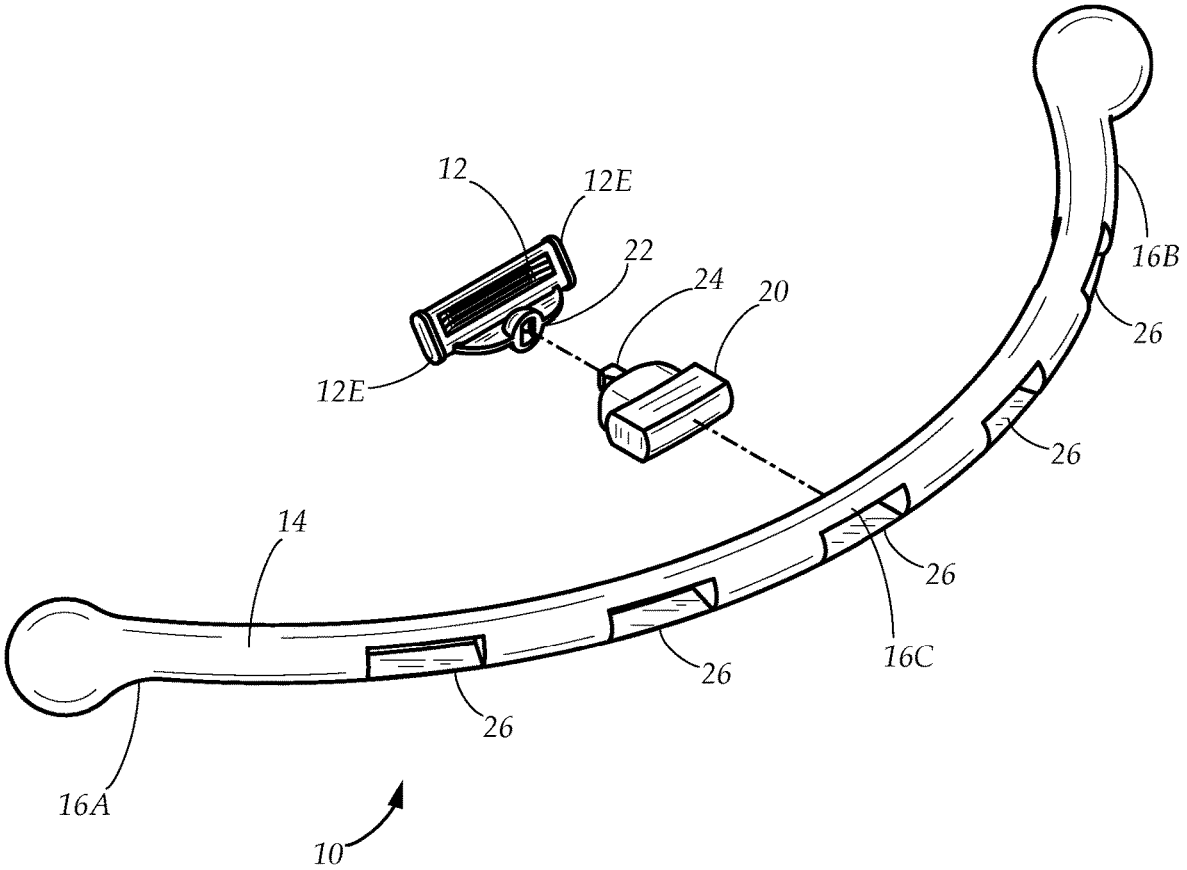
FIG. 2 is an exploded view of an embodiment of the nape hair shaving device, depicting a razor mounting insert adapted to detachably hold one of the razors and be inserted into an insert aperture of the arcuate shaving bar, in accordance with an embodiment of the present disclosure.
Figure 3:
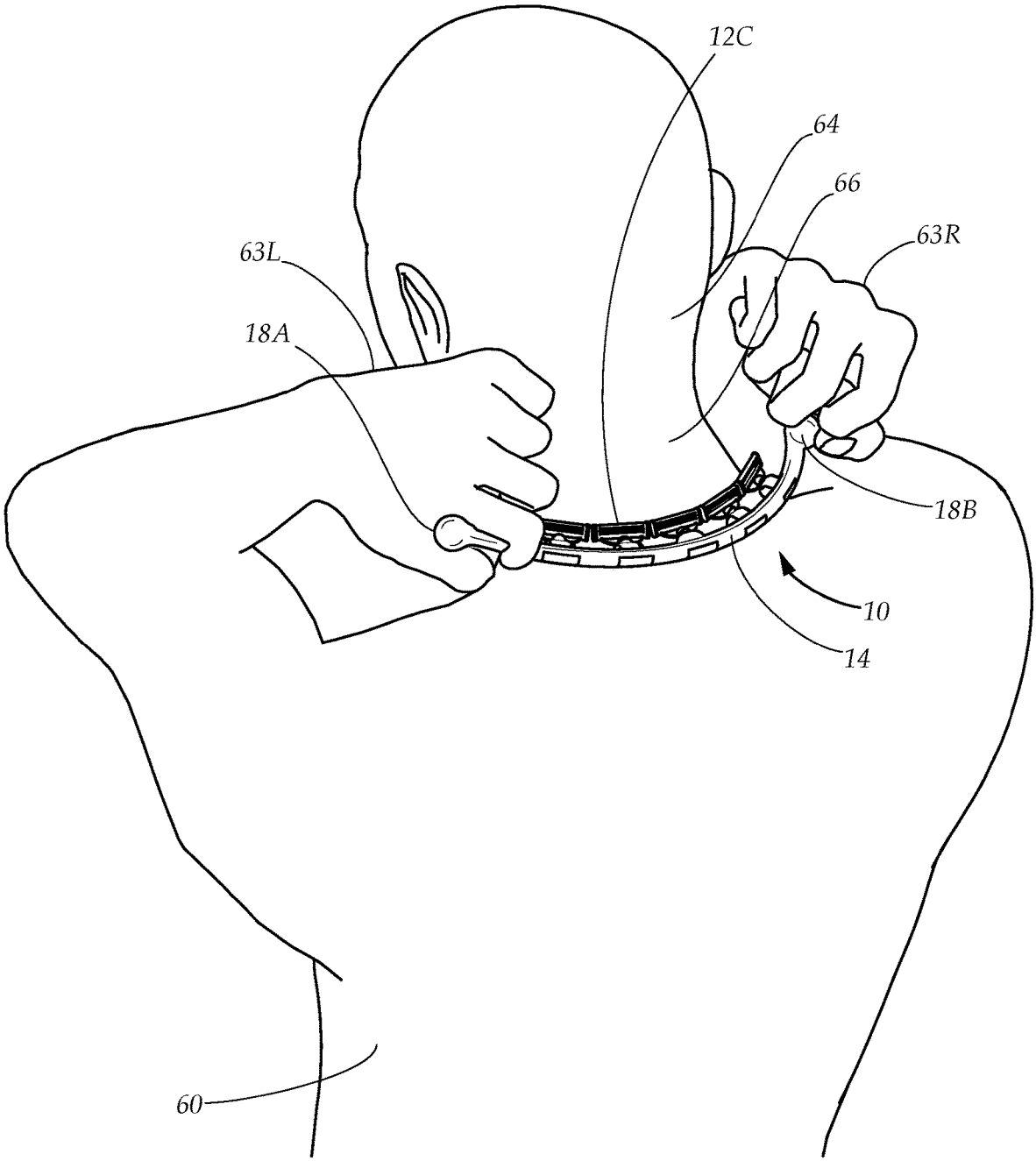
FIG. 3 is a diagrammatic perspective view of the user employing the nape hair shaving device by grasping the grips and positioning the razors above the nape of the user's neck, in accordance with an embodiment of the present disclosure.
Figure 4:
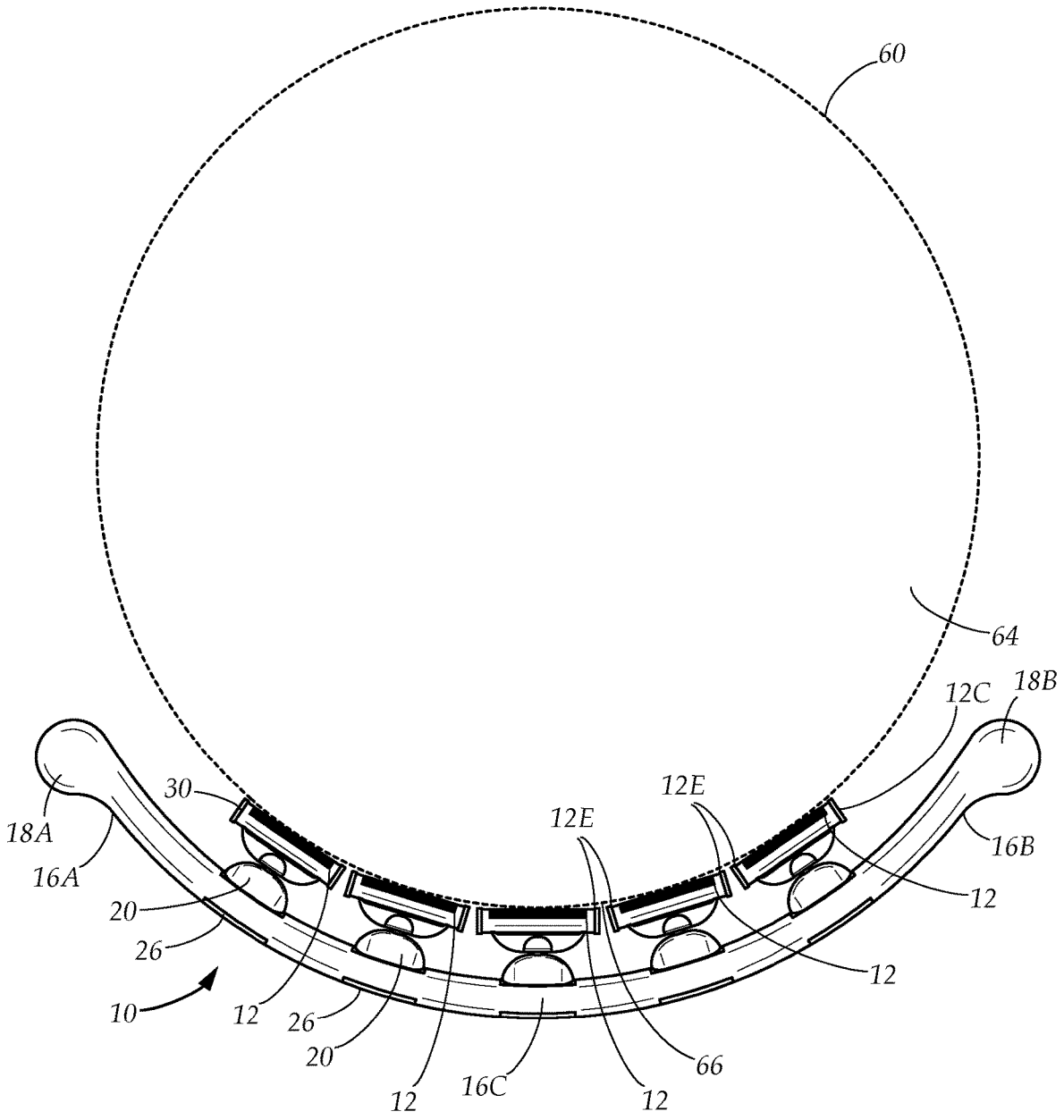
FIG. 4 is a diagrammatic top view showing the plurality of razors, whereby the cutting surfaces of the razors align to form a shaving arc for cutting hair growing on the nape of the user's neck, in accordance with an embodiment of the present disclosure.

FIGS. 1-2 illustrate a nape hair shaving device 10 comprising an arcuate shaving bar 14 adapted to hold a plurality of razors 12. The arcuate shaving bar 14 has a first end 16A, a distally oriented second end 16B, and a midpoint 16C located equidistant between the first and second ends 16A, 16B. The arcuate shaving bar 14 may optionally have a first and second grip 18A, 18B attached to the first and second ends 16A, 16B respectively. The first and second grips 18A, 18B are shaped to allow the user to better grasp the shaving device 10, and may be formed as enlarged projections which extend from the first and second ends 16A, 16B. The first and second ends 16A, 16B each project forwardly away from the midpoint 16C such that the arcuate shaving bar 14 is continuously curved from the first end 16A to the second end 16B. Each razor 12 has a pair of side edges 12E and a cutting surface 12C. In a preferred embodiment, the razors 12 are cartridge style razors, and the cutting surface 12C is formed of one or more individual blades. The arcuate shaving bar 14 further has a plurality of razor mounts 24 disposed at even intervals between the first and second ends 16A, 16B. Each razor 12 is attached to the arcuate shaving bar 14 via one of the razor mounts 24 such that each razor 12 is positioned adjacent to at least one of the other razors 12, and the cutting surface 12C of each razor 12 faces towards a space between the first and second ends 16A, 16B of the arcuate shaving bar 14. Turning briefly to FIGS. 3 and 4, a user 60 may employ the nape hair shaving device 10 by grasping the first and second grips 18A, 18B using the user's left and right hands 63L, 63R, and placing the nape hair shaving device 10 behind the user's neck 64 such that razors 12 are positioned above the nape 66 of the beck 64.

Returning to FIGS. 1-2, the arcuate shaving bar 14 is bendable and is formed of flexible plastic, silicone, or other suitable material, in order to allow the first and second ends 16A, 16B to be bent inwardly or outwardly, to bring the first and second end towards or away from each other. This allows the arcuate shaving bar 14 to bend to conform to the curve of the user's neck 64. In alternate embodiments, the arcuate shaving bar 14 may be rigid, and can be formed using plastic, lightweight metal, or other suitable material.

Each razor 12 further has a razor attachment point 22 disposed opposite the cutting surface 12C, which allows the razor 12 to be selectively attached to the razor mounts 24, to allow dulled razors to be detached and replaced as needed. In certain embodiments, the razor mounts 24 are disposed directly on the arcuate shaving bar 14. In a preferred embodiment, the nape hair shaving device 10 further has a plurality of razor mounting inserts 20, and the arcuate shaving bar 14 further has a plurality of insert apertures 26 positioned at evenly spaced intervals between the first and second ends 16A, 16B, which are adapted to receive and retain one of the razor mounting inserts 20. The razor mounts 24 are each disposed on one of the razor mounting inserts 20 instead of the arcuate shaving bar 14, and each razor 12 is therefore selectively attached to one of the razor mounting inserts 20. The razor mounting inserts 20 are formed from a rigid material such as plastic, and impart a degree of rigidity to the flexible arcuate shaving bar 14 once the razor mounting inserts 20 have been inserted into the insert apertures 26.

To facilitate retention of the razor mounting inserts 20 within the insert apertures 26, the insert apertures 26 may be sized and shaped to substantially match the razor mounting inserts 20, thus allowing the razor mounting inserts 20 to be securely held therein. In certain embodiments, the razor mounting inserts 20 may be formed as polygonal prisms, and may be slightly wider than the corresponding insert apertures 26. The flexible nature of the arcuate shaving bar 14 allows the insert apertures 26 to expand in order to receive and retain the razor mounting inserts 20. In certain embodiments, the razor mounting inserts 20 may be permanently affixed within the insert apertures 26, such as by using adhesive.

Alternatively, in certain embodiments, the razor mounting inserts 20 may be replaced as needed to allow razors 12 of different brands and configurations to be attached to the arcuate shaving bar 14. For example, different brands of razors 12 may have unique razor attachment points 22, and various types of razor mounting inserts 20 may be provided, each having razor mounts 24 adapted to attach to the razor attachment points 22 of the razors 12.

Turning now to FIG. 4 while also referring to FIG. 3, the razors 12 project from the arcuate shaving bar 14 and are aligned such that at least one side edge 12E of each razor 12 is adjacent to the side edge 12E of at least one other razor 12. The curvature of the arcuate shaving bar 14 allows the cutting surfaces 12C of the plurality of razors 12 to form a shaving arc 30 which conforms to the curve of the user's neck 64, further ensuring that more than one razor 12 will contact the nape 66 when the shaving device 10 is in use.

Figure 5:
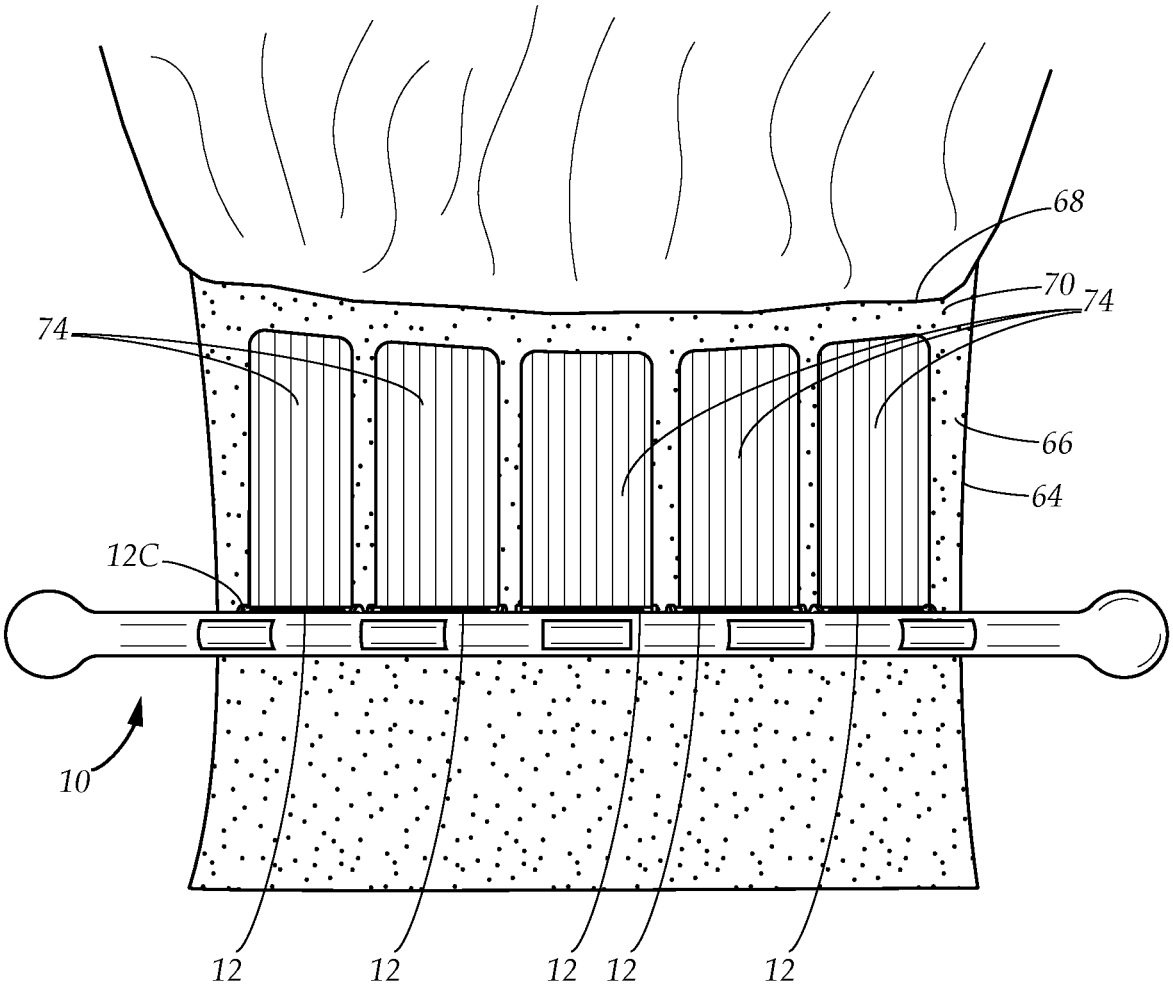
FIG. 5 is a diagrammatic front view of the nape hair shaving device being employed to cut the hair on the nape of the user's neck, whereby the razors produce a plurality of parallel and adjacent shaved areas, in accordance with an embodiment of the present disclosure.

Referring to FIG. 5 in addition to FIGS. 2-4, the shaving device 10 is employed to cut hair 70 growing from the nape 66 below a hairline 68. The user 60 may employ the shaving device 10 by grasping the first and second grips 18A, 18B, and positioning the shaving device 10 horizontally behind the user's neck 64 such that the neck 64 is positioned within the space between the first and second ends 16A, 16B. The shaving arc 30 is positioned above the nape 66 with the blades of the cutting surfaces 12C directed downwardly. The user 60 then aligns the shaving arc 30 with the hairline 68, and lowers the cutting surfaces 12C of the shaving arc 30 to contact the nape 66 below the hairline 68. The user 60 then performs a shaving motion by moving the shaving device 10 downwardly while the shaving arc 30 remains in contact with the nape 66, creating a plurality of shaved areas 74 along the nape 66 where the hair 70 has been cut away by the razors 12. Note that the shaving device 10 may alternatively be reversed so that the blades of the cutting surfaces 12C are directed upwardly, to allow the user to perform an upward shaving motion.

Due to gaps in the shaving arc 30 between the side edges 12E of the razors 12, portions of the hair 70 upon the nape 66 may remain uncut between the shaved areas 74. The user 60 may remove the uncut hair 70 by re-aligning the shaving arc 30 with the hairline 68, laterally adjusting the position of the shaving device to the left or right, lowering the cutting surfaces 12C of the shaving arc 30 to contact the nape 66 below the hairline 68, and then repeating the shaving motion to remove the uncut hair 70. Thus, by repeating the shaving motion with lateral adjustments, the user 60 may effect a smooth shave of the nape 66 by removing the hair 70 without assistance from another person. Alignment of the shaving arc 30 with the hairline 68 may be achieved either by touch, or through the use of a mirror.

Furthermore, due to the flexibility of the arcuate shaving bar 14, the shape of the arc 30 may be modified by the user 60 during usage of the shaving device 10 in order to accommodate the size and shape of the user's neck 64. In a preferred embodiment, the distance between the side edges 12E of the razors 12 within the shaving arc 30 can be decreased by bending the arcuate shaving bar 14 inwardly, or increased by bending the arcuate shaving bar 14 outwardly. Decreasing the distance between the side edges 12E of the razors 12 reduces the amount of uncut hair 70 between the shaved areas 74, whereas increasing the distance between the side edges 12E increases the width of the shaving arc. In certain embodiments where the razor mounting inserts 20 are rigid, the arcuate shaving bar 14 remains rigid around the insert apertures 26 to allow the alignment of the shaving arc 30 to be maintained during use, while the portions of the arcuate shaving bar 14 between the insert apertures 26 remains flexible to allow the arcuate shaving bar 14 to be bent inwardly or outwardly.

The shaving device 10 may employ any number of razors 12, to achieve the optimal removal of the hair 70 on the user's nape 66. In a preferred embodiment, one of the razors 12 is centrally positioned at the midpoint 16C of the arcuate shaving bar 14, while at least one razor 12 is positioned between the midpoint 16C and the first and second ends 16A, 16B respectively. For example, the shaving device 10 may include a total of five razors 12, with one razor positioned at the midpoint 16C, and two razors positioned between the midpoint 16C and each of the first and second ends 16A, 16B. The positioning of each razor 12 upon the arcuate shaving bar 14 is facilitated by the corresponding insert aperture 26 or razor mount 24 as appropriate.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a nape hair shaving device. The disclosure is illustrated by example in the drawing figures, and throughout the written description. It should be understood that numerous variations are possible, while adhering to the inventive concept. Such variations are contemplated as being a part of the present disclosure.

What is claimed is:

1. A method of shaving hair from a nape located behind a user's neck, the hair being located below a hairline, the user having a left and right hand, the method comprising the steps of: providing a shaving device having: a flexible arcuate shaving bar having a first end, a second end, and a midpoint centrally located therebetween, the arcuate shaving bar having a curved shape, the shaving bar bendable inwardly to bring the first and second ends closer together and bendable outwardly to draw the first and second ends further apart; and a plurality of razors disposed between the first and second ends of the arcuate shaving bar, each razor having a pair of side edges and a cutting surface, each razor positioned adjacent to another razor such that the cutting surface of each razor faces a space between the first and second ends, the plurality of razors forming a curved shaving arc which conforms to the nape of the user's neck, at least one side edge of each razor adjacent to the side edge of another razor within the shaving arc, the side edges of adjacent razors forming gaps therebetween such that adjacent razors do not contact each other when the arcuate shaving bar is not bent; horizontally positioning the shaving device behind the user's neck such that the shaving arc is above the nape and the neck is within the space formed between the first and second ends of the arcuate shaving bar;

lowering the shaving arc onto the nape such that the cutting surfaces of the shaving arc contact the nape; and performing a shaving motion by moving the shaving device downwardly to create a plurality of shaved areas along the nape where the hair is cut away by the razors of the shaving arc.

2. The method as described in claim 1, wherein:

the step of horizontally positioning the shaving device behind the user's neck further comprises the step of aligning the shaving arc with the hairline; and the step of lowering the shaving arc onto the nape further comprises placing the shaving arc in contact with the nape below the hairline.

3. The method as described in claim 2, wherein: the shaving device further comprises a first grip extending from the first end, and a second grip extending from the second end; and the step of horizontally positioning the shaving device further comprises the step of grasping the first and second grips with the left and right hands of the user.

4. The method as described in claim 3, wherein the step of horizontally positioning the shaving device behind the user's neck is followed by the step of selectively increasing or decreasing the distance between the side edges of the razors by alternatively bending the arcuate shaving bar outwardly or inwardly.

5. The method as described in claim 4, wherein:

the step of performing a shaving motion by the user is followed by the step of:

laterally adjusting the shaving device in the direction of the first or second ends, and repeating the shaving motion to remove any uncut hair between the plurality of shaved areas.

6. The method as described in claim 5, wherein:

the shaving device further has a plurality of razor mounts, and each razor is selectively attached to one of the razor mounts; and the steps as recited are followed by the step of:

detaching the plurality of razors from the plurality of razor mounts, and attaching a plurality of new razors to replace the razors which have been detached.

7. The method as described in claim 6, wherein:

the shaving device further has a plurality of razor mount inserts and each of the razor mounts is disposed on one of the razor mount inserts;

the arcuate shaving bar further has a plurality of insert apertures adapted to selectively receive and retain the razor mount inserts; and the steps as recited are followed by the step of:

selectively inserting or removing the razor mount inserts into or from within the insert apertures.

8. A method of shaving hair from a user's body part, the user having a left and right hand, the method comprising the steps of: providing a shaving device having: a flexible arcuate shaving bar having a first end, a second end, and a midpoint centrally located therebetween, the arcuate shaving bar having a curved shape, the shaving bar bendable inwardly to bring the first and second ends closer together and bendable outwardly to draw the first and second ends further apart; and a plurality of razors disposed between the first and second ends of the arcuate shaving bar, each razor having a pair of side edges and a cutting surface, each razor positioned adjacent to another razor such that the cutting surface of each razor faces a space between the first and second ends, the plurality of razors forming a curved shaving arc which conforms to the user's body part, at least one side edge of each razor adjacent to the side edge of another razor within the shaving arc, the side edges of adjacent razors forming gaps therebetween such that adjacent razors do not contact each other when the arcuate shaving bar is not bent; horizontally positioning the shaving device over the user's body part such that the shaving arc is above the body part and the body part is within the space formed between the first and second ends of the arcuate shaving bar; lowering the shaving arc onto the body part such that the cutting surfaces of the shaving arc contact the body part; and performing a shaving motion by moving the shaving device downwardly to create a plurality of shaved areas along the body part where the hair is cut away by the razors of the shaving arc.

9. The method as described in claim 8, wherein:

the shaving device further comprises a first grip extending from the first end, and a second end extending from the second end; and the step of horizontally positioning the shaving device further comprises the step of grasping the first and second grips with the left and right hands of the user.

10. The method as described in claim 9, wherein the step of horizontally positioning the shaving device over the user's body part is followed by the step of selectively increasing or decreasing the distance between the side edges of the razors by alternatively bending the arcuate shaving bar outwardly or inwardly.

11. The method as described in claim 10, wherein:

the step of performing a shaving motion by the user is followed by the step of:

laterally adjusting the shaving device in the direction of the first or second ends, and repeating the shaving motion to remove any uncut hair between the plurality of shaved areas.

12. The method as described in claim 11, wherein:

the shaving device further has a plurality of razor mounts, and each razor is selectively attached to one of the razor mounts; and the steps as recited are followed by the step of:

detaching the plurality of razors from the plurality of razor mounts, and attaching a plurality of new razors to replace the razors which have been detached.

13. The method as described in claim 12, wherein:

the shaving device further has a plurality of razor mount inserts and each of the razor mounts is disposed on one of the razor mount inserts;

the arcuate shaving bar further has a plurality of insert apertures adapted to selectively receive and retain the razor mount inserts; and the steps as recited are followed by the step of:

selectively inserting or removing the razor mount inserts into or from within the insert apertures.

* * * * *